US007721372B2

(12) United States Patent
Knopow et al.

(10) Patent No.: US 7,721,372 B2
(45) Date of Patent: May 25, 2010

(54) FABRIC SWEEPER

(75) Inventors: Jeremy F. Knopow, Burlington, WI (US); Chrissie M. Smits, Oak Creek, WI (US)

(73) Assignee: S.C. Johnson & Son, Inc., Racine, WI (US)

( * ) Notice: Subject to any disclaimer, the term of this patent is extended or adjusted under 35 U.S.C. 154(b) by 1051 days.

(21) Appl. No.: 11/141,099

(22) Filed: May 31, 2005

(65) Prior Publication Data

US 2006/0265823 A1 Nov. 30, 2006

(51) Int. Cl.
*A47L 25/00* (2006.01)

(52) U.S. Cl. ..... 15/27; 15/39.5; 15/48; 15/221

(58) Field of Classification Search ..... 15/27, 15/39.5, 40, 41.1, 44, 48, 97.1, 98, 221
See application file for complete search history.

(56) References Cited

U.S. PATENT DOCUMENTS

| | | | | | |
|---|---|---|---|---|---|
| 343,572 | A | * | 6/1886 | Drew | 15/41.1 |
| 426,116 | A | * | 4/1890 | Drew | 15/41.1 |
| 894,011 | A | * | 7/1908 | Kampfe | 15/48 |
| 972,690 | A | | 10/1910 | Goble | |
| 2,460,183 | A | | 1/1949 | Mayer | |
| 2,651,803 | A | | 9/1953 | Browne | |
| 3,316,577 | A | | 5/1967 | Kravos | |
| 3,618,153 | A | | 11/1971 | Coult | |
| 3,631,557 | A | | 1/1972 | Leifheit | |
| 3,651,529 | A | | 3/1972 | Popeil et al. | |
| 3,747,152 | A | | 7/1973 | Tsuruzawa | |
| 3,772,726 | A | * | 11/1973 | Kupperman et al. | 15/48 |
| 3,842,459 | A | | 10/1974 | Tsuruzawa et al. | |
| 3,900,911 | A | | 8/1975 | Hayashi | |
| 4,080,683 | A | | 3/1978 | Yi | |
| 4,462,134 | A | * | 7/1984 | Wang | 15/98 |
| 4,464,804 | A | | 8/1984 | Hopkins | |
| 4,596,059 | A | * | 6/1986 | Lee | 15/98 |
| 4,742,594 | A | * | 5/1988 | Chen | 15/98 |
| 4,765,012 | A | | 8/1988 | Ueda | |

(Continued)

FOREIGN PATENT DOCUMENTS

| | | | |
|---|---|---|---|
| DE | 69 10 003 | U | 7/1969 |

(Continued)

OTHER PUBLICATIONS

Product Advertisement for Quick Cleaner sold by Petio Yamahisa, 4 pages, undated, partial translation provided.

(Continued)

*Primary Examiner*—Mark Spisich

(57) ABSTRACT

The present invention is a device for use in cleaning a fabric surface of dust, dirt, pet hair and other debris present on the surface. The device includes a pair of cleaning members or rollers disposed on an underside of the device which can roll with respect to the device and with respect to one another. The rollers are selectively contacted with one another such that each roller can assist in removing debris picked up by the opposite roller and dispensing the debris into a collection chamber releasably positioned within the housing. The removal of the debris from each roller is also facilitated by opposed edges of a central opening in the housing that contact the rollers and direct the debris into the debris collection chamber.

20 Claims, 3 Drawing Sheets

U.S. PATENT DOCUMENTS

| | | | |
|---|---|---|---|
| 5,970,558 | A | 10/1999 | Canavan et al. |
| 6,895,627 | B1 | 5/2005 | Lin |
| 2005/0079315 | A1 | 4/2005 | Seth et al. |
| 2006/0265824 | A1 | 11/2006 | Knopow |
| 2006/0277706 | A1 | 12/2006 | Clark et al. |
| 2007/0202768 | A1 | 8/2007 | Haskett et al. |
| 2007/0220691 | A1 | 9/2007 | McKay |
| 2008/0040874 | A1 | 2/2008 | McKay |
| 2008/0041416 | A1 | 2/2008 | Matthews et al. |
| 2008/0052849 | A1 | 3/2008 | McKay |
| 2008/0052854 | A1 | 3/2008 | McKay |

FOREIGN PATENT DOCUMENTS

| | | | | |
|---|---|---|---|---|
| DE | 19 41 838 | A1 | | 2/1971 |
| DE | 20 31 696 | A1 | | 12/1971 |
| DE | 23 22 074 | A1 | | 11/1973 |
| FR | 1 444 493 | | | 7/1966 |
| GB | 1114881 | | | 5/1968 |
| GB | 2187377 | A | | 9/1987 |
| GB | 2257620 | A | | 1/1993 |
| JP | 63 216506 | A | | 9/1988 |
| JP | 63216506 | | | 9/1988 |
| JP | 2026527 | | | 1/1990 |
| JP | 8-25892 | | * | 1/1996 |
| JP | 10-58893 | | * | 3/1998 |
| JP | 11-178766 | | * | 7/1999 |
| WO | WO2006/130216 | A1 | | 12/2006 |
| WO | WO 2007/092038 | | | 8/2007 |

OTHER PUBLICATIONS

Photograph (top and bottom) of Quick Cleaner Product, 2 pages, undated.

* cited by examiner

FABRIC SWEEPER

FIELD OF THE INVENTION

The present invention relates to cleaning devices, and more specifically to a cleaning device for fabrics that is capable of picking up and retaining for disposal various debris located on a fabric surface.

BACKGROUND OF THE INVENTION

When cleaning fabric surfaces, often times mechanical vacuum cleaning devices are utilized in order to effectively remove dirt, dust, and other debris from the fabric surface. However, due to the often large and cumbersome construction of these types of mechanical vacuum fabric cleaning devices, these devices are often not suitable for use in certain situations where the fabric surface to be cleaned is relatively small, or is positioned in a difficult to access location. In addition, for various instances of spot cleaning certain fabric surfaces, a large mechanical cleaning device is often impractical for the particular cleaning task.

Therefore, in order to provide a lightweight cleaning device that can be utilized as an alternative to larger mechanical vacuum cleaning devices for these types of situations, various types of alternative cleaning devices and brushes have been developed. For example, Tsuruzawa U.S. Pat. No. 3,747,152 discloses a cleaning brush with dust removing and collection means. The device includes a rotatable or slidable brush that is mounted to a housing which can be grasped by an individual to move the brush across a surface to be cleaned. The movable brush is formed with a number of bristles which are oriented generally oppositely to bristles on a pair of brush members disposed on the housing surrounding the brush. The bristles on the movable brush pick up dirt from the surface by contacting the dirt as the brush is moved across the surface. The bristles then rotate into engagement with the bristles on the brush members in the housing to dislodge the dirt from the movable brush. The dirt and dust dislodged by the brush members is then collected within the movable brush opposite the bristles for later removal through an opening in the housing to which the movable brush is mounted.

However, this device has certain shortcomings in that the ability of the brush to effectively retain any dirt, dust or other debris picked up by the movable brush is determined by the contact of the bristles on the brush with the bristles of the brush members. Because the movable brush necessarily has to move into contact with the brush members from the exterior of the device, the brush can dislodge the dirt, dust and other debris from the movable brush before the dirt is located within the brush housing. Furthermore, for that component of the dirt, dust and other debris that is actually contained within the housing as a result of the proper operation of the device, the debris must be dispensed by inverting the device and shaking the housing such that the debris moves through an opening in the housing, which is a highly inefficient manner to remove the dirt from the device.

Therefore, it is desirable to develop a lightweight, manually operable fabric surface cleaning or sweeping device that engages dirt, dust and other debris picked up off of a fabric surface in a manner which more effectively removes the debris from the surface and deposits this debris within a collection chamber positioned in the device. Further, it is also desirable to develop a fabric cleaning device in which the dust or debris collected by the device can be more easily dispensed of using the separate collection chamber.

SUMMARY OF THE INVENTION

According to a primary aspect of the present invention, a fabric cleaning and/or sweeping device is provided within a housing that includes a pair of movable fabric cleaning members. The cleaning members are secured within a recess in the housing such that each member is engageable with the fabric to be cleaned and with the opposed fabric cleaning member. The movable cleaning members rotate with respect to the housing as the cleaning device is moved over the fabric surface, and pick up any dust, dirt or other debris on the fabric surface. The movable cleaning members are secured within the housing in a manner which enables the members to rotate independently of one another, but also that the cleaning members selectively come into contact with one another. When the cleaning members contact one another, the members effectively act as a cleaning mechanism for one another, urging the dust, dirt and other debris off of the opposite member and into a collection chamber for the device. The members can easily pick up dust, dirt and other debris from the fabric surface due to the construction of the cleaning members which include an outer surface formed of a material that readily attracts pet hair, crumbs, dust, lint, allergens and other materials present on the fabric surface. The materials are also chosen to be somewhat flexible such that the material, in addition to being cleaned by the material positioned on the opposed rotatable member, can be further cleaned of the dirt, dust and other debris picked up by the material as a result of the contact of the material on each cleaning member with the housing.

According to another aspect of the present invention, the housing includes a dirt collection chamber with an open lower end that is in communication with the space within which the rotatable members are positioned such that the dirt and dust picked up by the cleaning members is diverted through the housing into the collection chamber. The chamber is removably retained within the housing until such time as the chamber becomes filled with dirt, dust and other debris picked up by the cleaning members. The chamber can then be removed, emptied and/or replaced in order to ready the device for additional cleaning.

According to still another aspect of the present invention, the housing within which the cleaning members and the collection chamber are positioned is designed to enable easy handling and use by an individual to clean a fabric surface. Additionally, the housing is formed with a minimum of parts which can each be formed of lightweight materials that are relatively low cost and easy to manufacture into the housing components.

Numerous other aspects, features and advantages of the present invention will be made apparent from the following detail description taken together with the drawing figures.

BRIEF DESCRIPTION OF THE DRAWINGS

The drawings illustrate the best mode currently contemplated of practicing the present invention.

In the drawings.

DETAILED DESCRIPTION OF THE INVENTION

Figure 1:
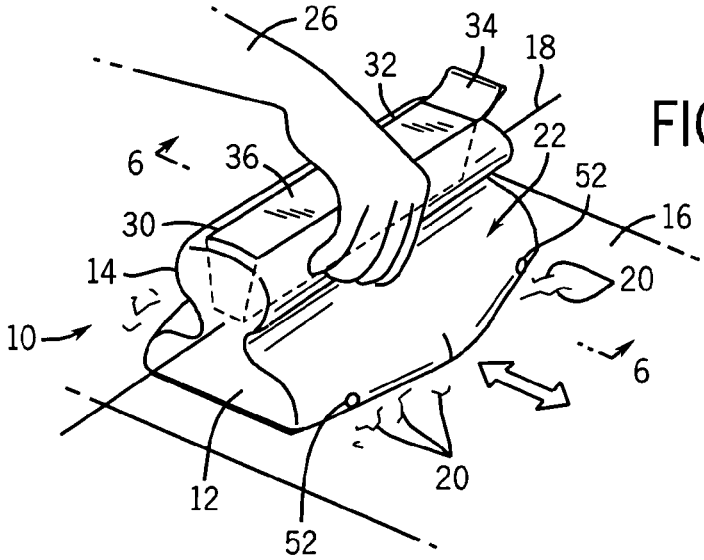
FIG. 1 is an isometric view of the fabric cleaning device of the present invention.
Figure 2:
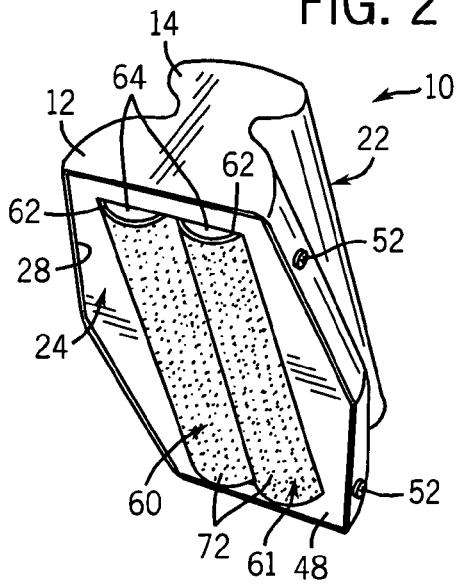
FIG. 2 is an isometric view illustrating the cleaning members of the device of FIG. 1.
Figure 3:
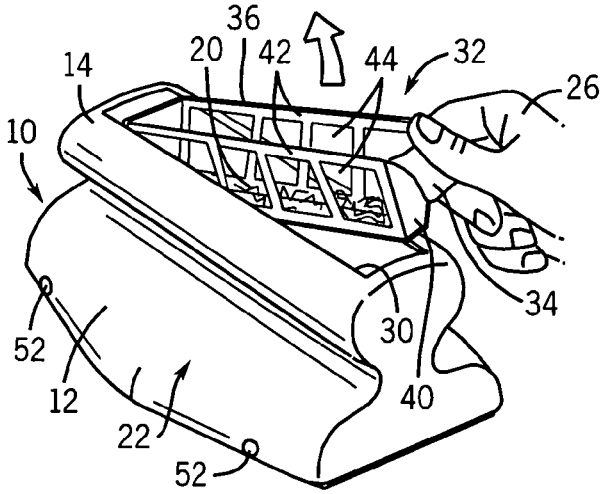
FIG. 3 is an isometric view illustrating the removal of a collection chamber of the device of FIG. 1.

With reference now to the drawing figures in which like reference numerals designate like parts throughout the disclosure, a fabric cleaning device constructed according to the present invention is indicated generally at 10 in FIG. 1. The device 10 includes a base portion 12 and a handle portion 14 extending upwardly from the base portion 12. When in use, the base portion 12 of the device 10 is positioned on a fabric surface 16 and moved in a direction generally perpendicularly to the long axis 18 of the device 10 in order to pick up debris 20 disposed on the fabric surface 16.

Referring now to FIGS. 1-6, the device 10 is formed with an outer housing 22 and an inner housing 24. Both the outer housing 22 and inner housing 24 are formed of a generally rigid material, that is also preferably lightweight, in order to enable the device 10 to be easily manipulated by an individual's hand 26, as best shown in FIG. 1. Most preferably, each housing 22 and 24 is constructed of a plastic material, such that the shape of the respective housings 22 and 24 can be easily modified as desired, and formed in a conventional plastic molding process.

The outer housing 22 includes a lower opening 28 within which the inner housing 24 is located, and an upper opening 30 positioned generally opposite the lower opening 28. The upper opening 30 can have any desired shape, but is preferably rectangular in shape in order to accommodate a collection chamber or bin 32 therein. The bin 32 includes a handle 34 at one end to facilitate the removal of the bin 32 from within the upper opening 30 in the outer housing 22. The bin 32 is also formed of a generally lightweight material, such as a plastic material, and includes a wide, closed end 36 at the top of the bin 32, and a narrow open end 38 at the bottom of the bin 32. Inwardly taping end walls 40 extend between the closed end 36 and open end 38 at each end of the bin 32, and are joined by sidewalls 42. The side walls 42 are integrally formed with the end walls 40 and include a number of open sections 44 spaced therealong. The open sections 44 allow an individual to view the interior of the bin 32 in order to determine how much debris 20 has been collected therein. The open sections 44 are preferably enclosed by a transparent material 46 that can extend from one side of the open end 38 over the adjacent side wall 42, over the top of the bin 32 to form the closed end 36, and down over the opposed side wall 42. In this embodiment, the transparent material 46 allows an individual to view the interior of the bin 32 regardless of whether the bin 32 is positioned within or removed at least partially from the upper opening 30 in the device 10. Additionally, to provide a more aesthetically pleasing appearance to the device 10, the closed end 36 of the bin 32 can be formed of material similar to the material forming the housing 22 to provide a more seamless appearance between the closed end 36 of the bin 32 and the handle portion 14 of the device 10.

Figure 4:
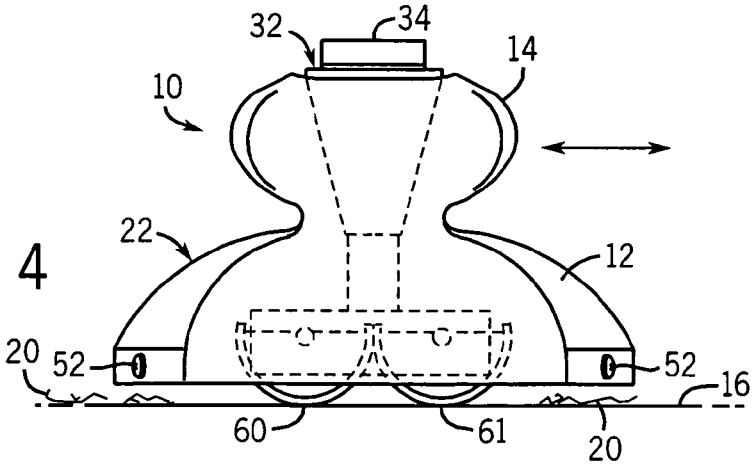
FIG. 4 is an end elevational view of the device of FIG. 1.
Figure 5:
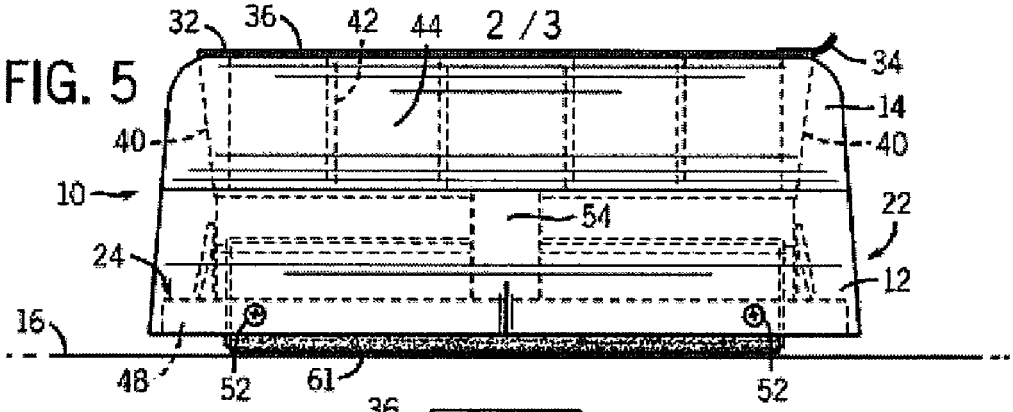
FIG. 5 is a side elevational view of the device of FIG. 1.
Figure 6:
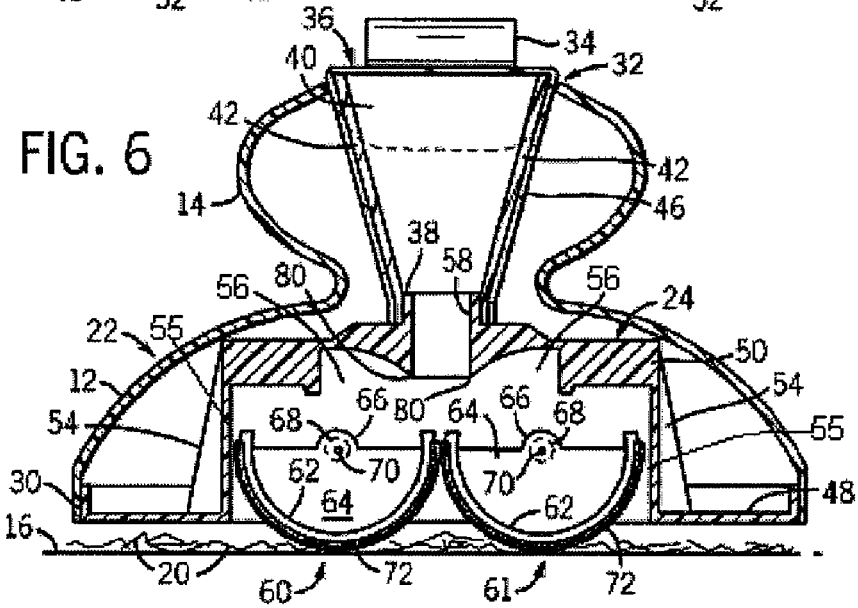
FIG. 6 is a cross-sectional view along lone 6-6 of FIG. 1.

Referring now to FIGS. 4-6, the inner housing 24 includes a lower portion 48 and an upper portion 50. The lower portion 48 extends outwardly to conform to the shape of the lower opening 28 in the outer housing 22, and is fixedly secured to the outer housing 22 by suitable fasteners 52. The upper portion 50 is spaced above the lower portion 48 by a pair of opposed supports 54 and end walls 55, preferably integrally formed between the lower portion 48 and the upper portion 50, in order to define a recess 56 between the side supports 54 and end walls 55. The upper portion 50 also includes a central opening 58 having lower edges 80 that extends completely through the upper portion 50 and allows communication between the recess 56 and the narrow open end 38 of the bin 32. To keep the device 10 relatively lightweight, the inner housing 24 is formed of a suitable lightweight material, such as a plastic material.

The recess 56 also houses a pair of cleaning members 60 and 61. The members 60, 61 are generally semi-cylindrical in shape, such that each member 60, 61 includes a curved surface 62, and a pair of arcuate end walls 64. Each end wall 64 includes a protrusion 66 extending outwardly therefrom in which is defined a bore 68 that receives a fastener 70 in order to rotatably secure each end wall 64 to the adjacent end wall 55 of the recess 56. While the preferred embodiment discloses cleaning members 60, 61 that are generally semi-cylindrical in shape, other suitable shapes for the members 60, 61 are also contemplated. Further, the materials utilized to form the cleaning members 60, 61 are selected to maintain the overall light weight for the device 10, such that preferred materials for the cleaning member 60 can include various lightweight metals and plastics.

Each cleaning member 60, 61 also includes a layer of cleaning material 72 secured to the member 60, 61 on the curved surface 62 opposite the end wall 64. The material 72 can be selected from any suitable material capable of picking up and retaining various dirt, dust, pet hair, crumbs, lint and other allergens from a fabric surface 16 such as a number of teeth disposed, and possibly integrally formed on each member or a material secured to the members 60, 61. Preferably, the material is formed of a cloth-like material, with a particularly preferred material being an unidirectional, fabric, such as velour. The layer of cleaning material 72 is secured to the curved surface 62 of the cleaning members 60, 61 in any suitable manner, but is preferably fixedly secured to the curved surface 62 by an adhesive.

The cleaning members 60, 61 are secured within the recess 56 such that the layer of cleaning material 72 on each member 60, 61 extends below the lower portion 48 of the inner housing 24 and into contact with a fabric surface 16 over which the device 10 is moved. Each member 60, 61 is rotatable within the recess 56 between a first position where an inner side 74 is rotated into contact with an annular shoulder 76 formed on the upper portion 50 of the inner housing 24 adjacent the opening 58, and a second position where an outer side 78 of each member 60, 61 is rotated into contact with the upper portion 50 adjacent the corresponding side support 54. Additionally, the thickness of the layer of cleaning material 72 on each member 60, 61 is selected to enable the material 72 on each member 60, 61 to contact the material 72 on the opposed cleaning member 60 for a purpose to be described.

Figure 7:
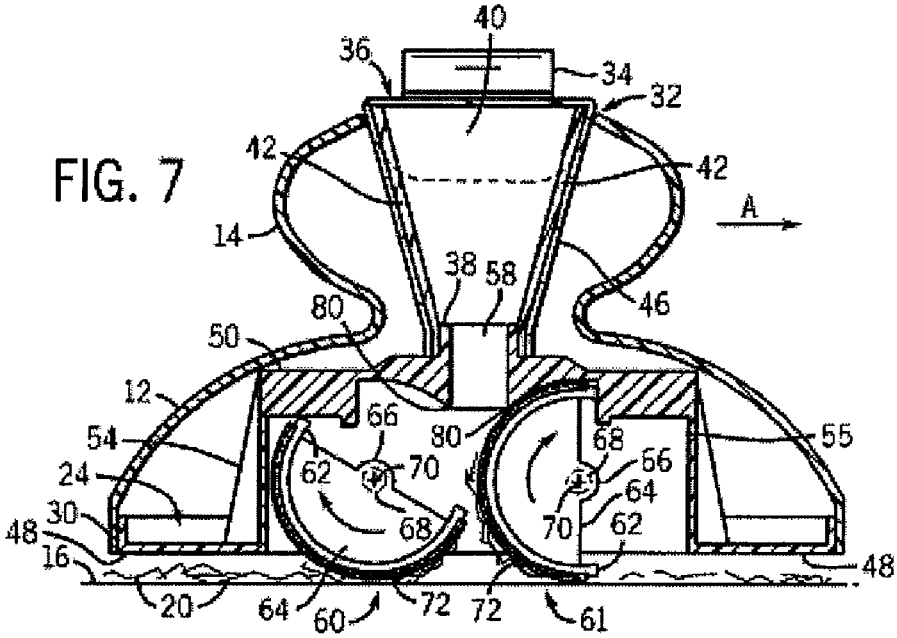
FIG. 7 is a cross-sectional view similar to FIG. 6 illustrating the movement of the cleaning members of the device of FIG. 1 when the device is moved in a first direction.
Figure 8:
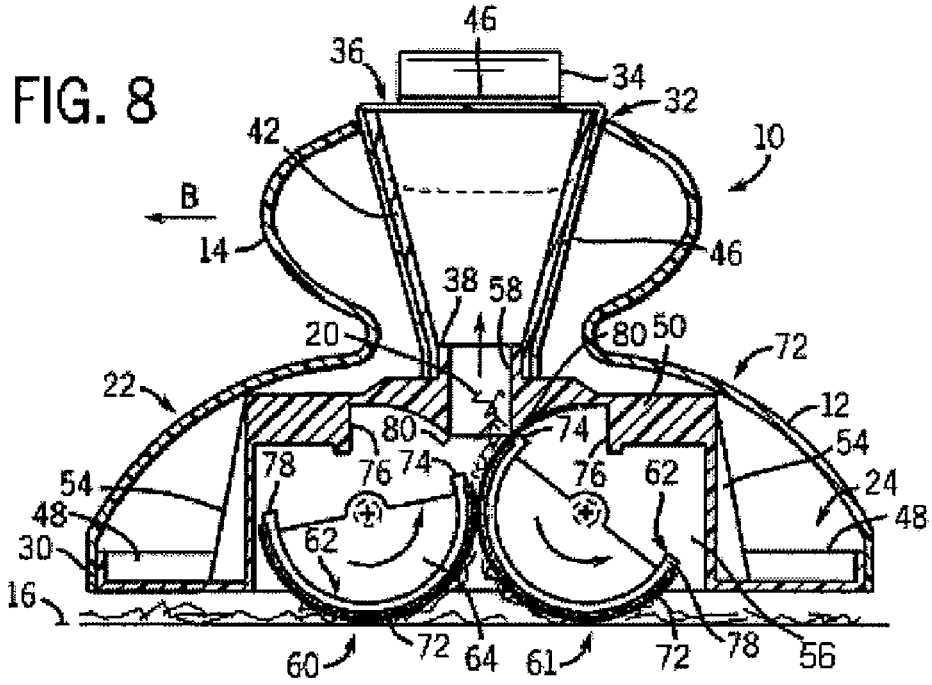
FIG. 8 is a cross-sectional view similar to FIG. 6 illustrating the movement of the rotatable members of the cleaning device when the device is moved in a second direction opposite to FIG. 7.
Figure 9:
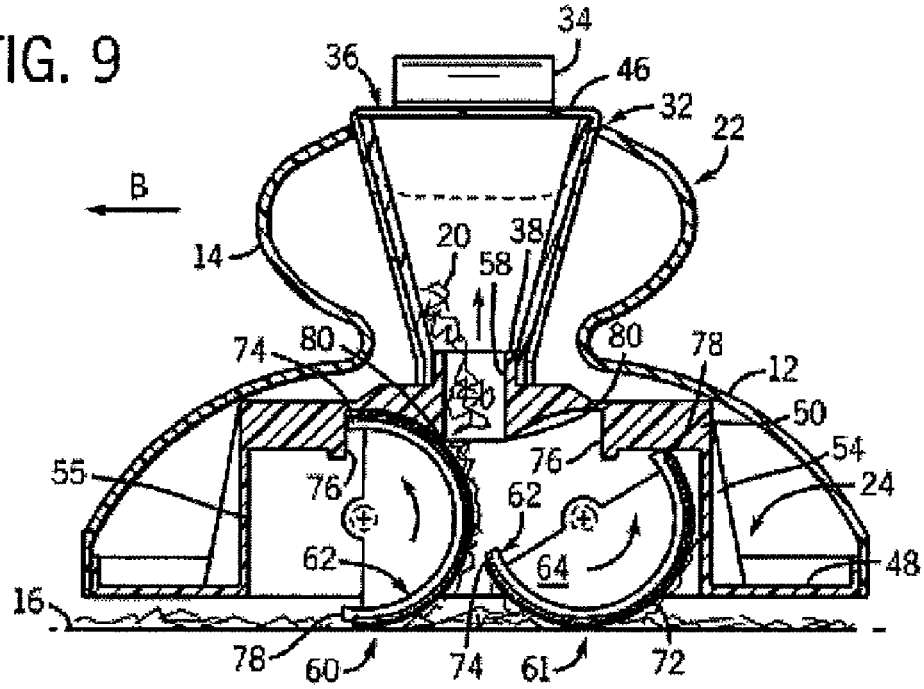
FIG. 9 is a cross-sectional view similar to FIG. 6 illustrating the movement of the rotatable cleaning members when the device is moved further in the direction of FIG. 8.

In operation, referring now to FIGS. 7-9, the device 10 is placed against and moved across a fabric surface 16, and the cleaning members 60, 61 each rotate in a clockwise direction when the device 10 is moved in a direction indicated by arrow A in FIG. 7. As the members 60, 61 rotate in the clockwise direction, the layer of cleaning material 72 on each member 60, 61 contacts the debris 20 on the fabric surface 16 and picks up the debris 20 such that the debris 20 remains on the cleaning material layer 72. The device 10 is continually moved in the direction indicated by arrow A until the cleaning members 60, 61 are moved into the position shown in FIG. 7.

At this point, the device 10 is moved in the opposite direction indicated by arrow B in FIG. 8, such that members 60, 61 rotate in a counterclockwise direction. In doing so, the cleaning material layer 72 on the inner side 74 of member 60 contacts the cleaning material layer 72 adjacent the inner side 74 of cleaning member 61. As the respective layers 72 move past and contact one another, the debris 20 on the member 61 is removed and pushed through the central opening 58 in the upper portion 50 into the open end 38 of the bin 32. The debris 20 engaged between the members 60, 61 is continually urged upwardly into the opening 50, and cannot fall back on the surface 16 due to the close spacing of the members 60, 61. At the same time, the cleaning material layer 72 spaced from the inner side 74 of member 61 comes into contact with the fabric surface 16 in order to pick up additional debris 20 from the surface 16. Movement in the direction indicated by arrow B is continued in this manner until, as best shown in FIG. 9, the position of the cleaning member 60, 61 is essentially reversed from FIG. 7. From the position shown in FIG. 9, the device 10 is again moved in a direction indicated by arrow A in FIG. 7 such that the inner side 74 of cleaning member 61 comes into contact with and cleans the debris 20 off of the cleaning material 72 of cleaning member 60, which picks up debris 20 from the surface 16 as it is moved. This process can be repeated as many times as necessary in order for the cleaning members 60, 61 to remove all of the debris 20 off of the fabric surface 16.

The removal of the debris 20 from the cleaning material layer 72 on each cleaning member 60, 61 is further facilitated by the presence of the debris diverting edge 80 formed on the upper portion 50 of the inner housing 24 on each side of the central opening 58. The edges 80 on each side of the opening 58 contact the cleaning material layer 72 on the respective cleaning members 60, 61 when the members 60, 61 move into the positions shown in FIGS. 7 and 9 to assist in diverting and removing the debris 20 from the cleaning material 72. The edges 80 contact the layers 72 on the members 60, 61 to compress the layers 72 and scrape or otherwise direct the debris 20 from the layers 72 into the opening 58. Continued motion of the members 60, 61 moves the layers 72 along the edges 80 to remove additional debris 20 from the members 60, 61.

After the debris 20 has been removed from the fabric surface 16, an individual can remove and replace the bin 32, if necessary, or can utilize the device in order to remove debris 20 from an additional fabric surface or surfaces 16. In addition, as opposed to the bin 32 being designed for removal and disposal separately from the device 10, the entire device 10 can be designed to be disposed once the bin 32 has been filled with debris 20 removed from one or more fabric surfaces 16.

Additionally, separate from the previously described embodiments, other modifications to the device 10 are also contemplated as within the scope of the invention. For example, the chamber or bin 32 can be integrally formed with the outer housing 22, such that the entire device is disposable. Also, the chamber 32 can include or be formed of a hair or lint attracting material, such as a strip of a tacky material or a hook and loop material to trap any lint, hair or other debris contacting it. Also, the opening 58 in the lower housing 24 could be moved to one side or the other of the lower housing 24, along with a corresponding shift in the location of the chamber 32

Various other features, embodiments and advantages of the present invention are contemplated as being within the scope of the following claims particularly pointing out and distinctly claiming the subject matter regarded as the invention.

We hereby claim:

1. A fabric cleaning device comprising:

a) a housing having a lower end and an upper end defining a recess therebetween, the upper end including a central opening in connection with the recess and at least one debris removing surface located adjacent the central opening;

b) a first cleaning member movably secured within the recess to extend at least partially out of the housing and engageable with the at least one debris removing surface, wherein the first cleaning member is semi-cylindrically shaped;

c) a debris collection chamber located in communication with the central opening; and d) an outer shell connected to and disposed around the housing and the collection chamber, wherein the outer shell includes an aperture generally opposite the housing within which the collection chamber is releasably positioned.

2. The device of claim 1 wherein the at least one debris removing surface comprises an edge of the central opening.

3. The device of claim 1 wherein the at least one debris removing surface is a second cleaning member movably secured within the recess adjacent to the first cleaning member.

4. The device of claim 1 wherein the first cleaning member includes an exterior cleaning surface and an interior support surface.

5. The device of claim 4 wherein the exterior cleaning surface is formed of a flexible material.

6. The device of claim 5 wherein the exterior cleaning surface is formed of a fabric material and wherein the debris collection chamber is transparent and formed from a plastic.

7. The device of claim 1 wherein the collection chamber has an open end in communication with the central opening.

8. The device of claim 1 wherein the collection chamber is releasably secured to the housing.

9. A fabric cleaning device comprising:

a) a housing having a lower end and an upper end defining a recess therebetween;

b) a first cleaning member movably secured to the housing within the recess;

c) a second cleaning member movably secured to the housing within the recess and selectively engageable with the first cleaning member, wherein the first cleaning member and the second cleaning member have a semi-cylindrical shape, defining end surfaces with an arc-shaped surface there between and wherein when the neutral cleaning member and second cleaning member define a first position wherein the end surfaces of the first and second cleaning members are generally aligned and a central portion of each cleaning member between the respective end surfaces faces downwardly;

d) a debris collection chamber connected to the housing and spaced from the recess; and e) at least one scraping edge disposed within the recess and engageable with one of the first cleaning member and the second cleaning member, wherein the first cleaning member and the second cleaning member are unengaged with the scraping edge when in the neutral position.

10. The device of claim 9, further comprising an outer shell connected to and disposed around the housing and the collection chamber, wherein the outer shell includes an aperture generally opposite the housing within which the collection chamber is secured.

11. The device of claim 9, wherein the first cleaning member and the second cleaning member are selectively rotatable within the recess between a first position wherein an inner side of the first cleaning member and an inner side of the second cleaning member are rotated into contact with an annular shoulder formed on an upper portion of the housing adjacent to the recess and a second position wherein an outer side of the first cleaning member and an outer side of the second cleaning member contacts the upper portion adjacent a corresponding side support.

12. A fabric cleaning device comprising:

a) a housing having a lower end and an upper end defining a recess therebetween;

b) a first cleaning member movably secured to the housing within the recess;

c) a second cleaning member movably secured to the housing within the recess; and d) a debris collection chamber connected to the housing and spaced from the recess;

wherein the first cleaning member and the second cleaning member have a semi-cylindrical shape;

wherein the first cleaning member and the second cleaning member are selectively rotatable within the recess between a first position wherein an inner side of the first cleaning member and an inner side of the second cleaning member are rotated into contact with an annular shoulder formed on an upper portion of the housing adjacent to the recess and a second position wherein an outer side of the first cleaning member and an outer side of the second cleaning member is rotated into contact with the upper portion adjacent a corresponding side support.

13. The device of claim 12, wherein when the first cleaning member is rotated to the first position the second cleaning member is rotated to the second position and wherein the first cleaning member is rotated to the second position the second cleaning member is rotated to the first position.

14. The device of claim 13, wherein the first cleaning member and the second cleaning member have a layer of cleaning material attached to a surface thereof.

15. The device of claim 13, wherein a thickness of the layer of cleaning material is configured to enable the layer on the first cleaning member to contact the layer on the second cleaning member when the first cleaning member and the second cleaning member are rotated with respect to one another.

16. The device of claim 15, wherein the housing comprises an inner housing and an outer housing, wherein the inner housing is secured within the outer housing.

17. The device of claim 16, wherein the debris collection chamber is integrally formed within the outer housing such that the device is disposable.

18. The device of claim 16, wherein the outer housing includes an opening for removing the debris collection chamber therethrough.

19. The device of claim 18, wherein the debris collection chamber includes one of a hair and lint attracting material.

20. The device of claim 19, wherein the debris collection chamber includes one of a strip of tacky material or a hook and loop material configured to trap lint, hair, or other debris.

* * * * *

UNITED STATES PATENT AND TRADEMARK OFFICE

CERTIFICATE OF CORRECTION

PATENT NO. : 7,721,372 B2
APPLICATION NO. : 11/141099
DATED : May 25, 2010
INVENTOR(S) : Jeremy F. Knopow et al.

It is certified that error appears in the above-identified patent and that said Letters Patent is hereby corrected as shown below:

Column 8, Line 9: replace "13" with --14--

Signed and Sealed this

Twenty-sixth Day of October, 2010

David J. Kappos

David J. Kappos
*Director of the United States Patent and Trademark Office*